US008059040B2

(12) United States Patent
Ayala Vazquez et al.

(10) Patent No.: US 8,059,040 B2
(45) Date of Patent: Nov. 15, 2011

(54) WIRELESS ELECTRONIC DEVICES WITH CLUTCH BARREL TRANSCEIVERS

(75) Inventors: Enrique Ayala Vazquez, Watsonville, CA (US); Hao Xu, Cupertino, CA (US); Gregory A. Springer, Sunnyvale, CA (US); Bing Chiang, Cupertino, CA (US); Eduardo Lopez Camacho, Watsonville, CA (US); Douglas B. Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 444 days.

(21) Appl. No.: 12/238,388

(22) Filed: Sep. 25, 2008

(65) Prior Publication Data

US 2010/0073243 A1 Mar. 25, 2010

(51) Int. Cl.
*H01Q 1/24* (2006.01)

(52) U.S. Cl. ..... 343/702; 343/700 MS

(58) Field of Classification Search ..... 343/702, 343/700 MS; 362/561, 607
See application file for complete search history.

(56) References Cited

U.S. PATENT DOCUMENTS

| | | | | |
|---|---|---|---|---|
| 5,258,892 | A | 11/1993 | Stanton et al. | |
| 6,392,610 | B1 | 5/2002 | Braun et al. | |
| 6,414,643 | B2 | 7/2002 | Cheng et al. | |
| 6,421,029 | B1 | 7/2002 | Tanabe | |
| 6,448,942 | B2 | 9/2002 | Weinberger et al. | |
| 6,539,608 | B2 | 4/2003 | McKinnon et al. | |
| 6,570,538 | B2 | 5/2003 | Vaisanen et al. | |
| 6,982,879 | B1 * | 1/2006 | Franca-Neto et al. | 361/803 |
| 7,280,075 | B2 * | 10/2007 | Koyama et al. | 343/702 |
| 7,345,646 | B1 | 3/2008 | Lin et al. | |
| 7,486,975 | B2 * | 2/2009 | Mori | 455/575.7 |
| 2005/0033513 | A1 * | 2/2005 | Gasbarro | 701/213 |
| 2006/0158379 | A1 | 7/2006 | Ishimiya | |
| 2007/0126651 | A1 | 6/2007 | Snyder et al. | |
| 2007/0133221 | A1 * | 6/2007 | Liu | 362/561 |
| 2007/0140072 | A1 | 6/2007 | Agrawal et al. | |

OTHER PUBLICATIONS

U.S. Appl. No. 12/142,744, filed Jun. 19, 2008, Ayala et al.
"AirPort Product-Specific Details", AirPort Developer Note, [Online], Updated: Apr. 28, 2008, Retrieved: Sep. 25, 2008, <http://developer.apple.com/documentation/HardwareDrivers/Conceptual/HWTech_Airport/Articles/AirP_implementation.html>.

* cited by examiner

*Primary Examiner* — Hoanganh Le
(74) *Attorney, Agent, or Firm* — Treyz Law Group; G. Victor Treyz; David C. Kellogg

(57) ABSTRACT

Wireless portable electronic devices such as laptop computers are provided with antennas and radio-frequency transceiver circuitry. Antenna structures and transceiver circuitry may be provided within a clutch barrel in a laptop computer. The clutch barrel may have a dielectric cover. Antenna elements may be mounted within the clutch barrel cover on an antenna support structure. The antenna support structure may be mounted to a metal housing frame. The metal housing frame may have a tab-shaped extension that serves as a heat sink. The heat sink may draw heat away from the transceiver circuitry. The transceiver circuitry may be coupled to the antenna using a radio-frequency transmission line path that contains microstrip transmission lines or coaxial cable transmission lines. The transceiver circuitry may be coupled to logic circuitry on a laptop computer motherboard using a digital data communications path.

23 Claims, 12 Drawing Sheets

WIRELESS ELECTRONIC DEVICES WITH CLUTCH BARREL TRANSCEIVERS

BACKGROUND

This invention relates to wireless electronic devices, and more particularly, to wireless electronic devices with transceiver circuitry for handling antenna signals.

Antennas are used in conjunction with a variety of electronic devices. For example, computers use antennas to support wireless local area network communications. Antennas are also used for long-range wireless communications in cellular telephone networks.

It can be difficult to design antennas for modern electronic devices, particularly in electronic devices in which compact size and pleasing aesthetics are important. If an antenna is too small or is not designed properly, antenna performance may suffer. At the same time, an overly-bulky antenna or an antenna with an awkward shape may detract from the appearance of an electronic device or may make the device larger than desired.

Radio-frequency antenna signals are generally handled with transceiver circuitry. For example, a radio-frequency transmitter may be used in transmitting radio-frequency signals through an antenna. Radio-frequency receiver circuitry may receive antenna signals.

Transceiver circuitry and antennas generally have different mounting requirements. In laptop computers, for example, transceiver circuitry is typically mounted on a motherboard in the laptop base, whereas antennas are mounted in more exposed locations where signal reception is not blocked by conductive materials. In situations such as these, coaxial cables may be used to convey radio-frequency signals between the transceiver and the antenna.

Arrangements in which coaxial cables are used to convey radio-frequency signals between a remote antenna and a transceiver circuit may be subject to nonnegligible cable losses. This can adversely affect radio-frequency performance. For example, in a typical laptop computer arrangement about 1.5 dB of signal losses may be introduced by a coaxial cable as the signals are passed to a radio-frequency input amplifier from the antenna. Because these signal losses are imposed on the antenna signal before the signal reaches the amplifier, the signal-to-noise ratio of the system is adversely affected.

It would therefore be desirable to be able to provide improved ways in which to provide electronic devices with antennas and transceivers.

SUMMARY

Wireless portable electronic devices such as laptop computers may be provided with antennas and radio-frequency transceiver circuitry. A wireless portable electronic device may have upper and lower housing portions that are joined using a hinge. The hinge may be associated with a clutch barrel having a dielectric clutch barrel cover. In a given device, one or more antenna elements may be mounted in the clutch barrel under the clutch barrel cover. These elements may form an antenna system. Radio-frequency transceiver circuitry may also be mounted in the clutch barrel under the clutch barrel cover. The radio-frequency transceiver circuitry may be coupled to the antenna system using a radio-frequency transmission line path. The length of the radio-frequency transmission line path may be minimized by mounting the radio-frequency transceiver circuitry adjacent to the antenna system.

Logic circuitry may be mounted on a printed circuit board in the lower housing portion. The logic circuitry may produce digital data signals. A digital data path may be coupled between the logic circuitry in the lower housing and the transceiver circuitry. The transceiver circuitry may have digital data communications circuitry that receives digital data signals from the logic circuitry in the lower housing. The transceiver circuitry may generate corresponding radio-frequency signals that are passed to the antenna system over the radio-frequency transmission line path and that are transmitted through the antenna system. Received antenna signals may also be processed by the transceiver and conveyed to the logic circuitry over the digital data path.

The antenna system may be formed from one or more antenna elements. System performance may be enhanced by using different types of elements in the same antenna system. For example, a clutch barrel antenna may be formed using a first antenna element and a second antenna element of different types. These antenna elements may be flex circuit elements that are mounted to a dielectric antenna support structure. The dielectric antenna support structure may be mounted to a metal frame within the clutch barrel.

The metal frame may have a tab-shaped heat sink extension. The tab-shaped extension may serve to draw heat away from the transceiver circuitry during operation of the transceiver circuitry.

Further features of the invention, its nature and various advantages will be more apparent from the accompanying drawings and the following detailed description of the preferred embodiments.

DETAILED DESCRIPTION

The present invention relates to antennas and transceivers for wireless electronic devices. The wireless electronic devices may, in general, be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. Portable wireless electronic devices may also be somewhat smaller devices. Examples of smaller portable electronic devices include wrist-watch devices, pendant devices, headphone and earpiece devices, other wearable and miniature devices, and handheld electronic devices. The portable electronic devices may be cellular telephones, media players with wireless communications capabilities, handheld computers (also sometimes called personal digital assistants), remote controls, global positioning system (GPS) devices, and handheld gaming devices. Devices such as these may be multifunctional. For example, a cellular telephone may be provided with media player functionality or a tablet personal computer may be provided with the functions of a remote control or GPS device.

Portable electronic devices such as these may have housings. Arrangements in which antennas and transceivers are incorporated into the clutch barrel housing portion of portable computers such as laptops are sometimes described herein as an example. This is, however, merely illustrative. Antennas and transceivers in accordance with embodiments of the present invention may be located in any suitable housing portion in any suitable wireless electronic device.

Figure 1:
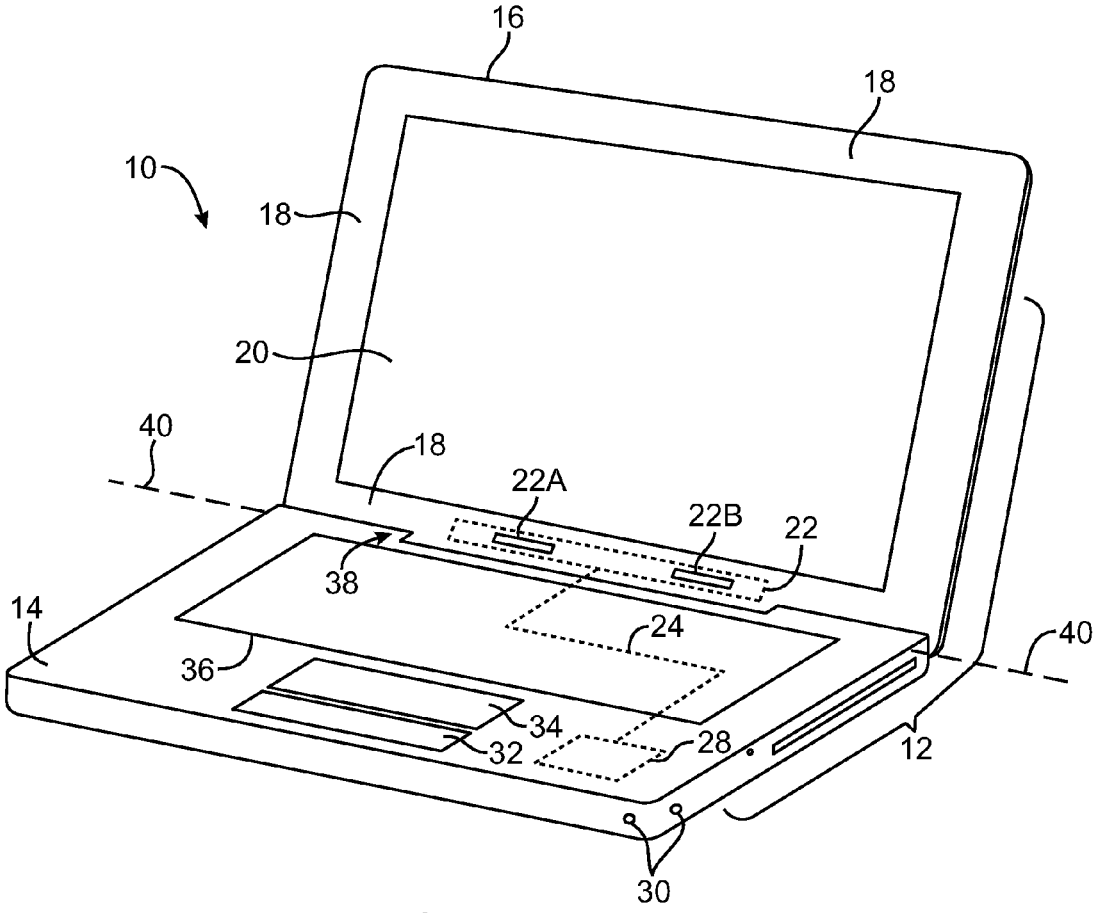
FIG. 1 is a perspective view of an illustrative wireless electronic device such as a laptop computer that may be provided with transceiver structures in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

As shown in FIG. 1, device 10 may have a housing 12. Housing 12, which is sometimes referred to as a case, may have an upper portion such as portion 16 and lower portion such as portion 14. Upper housing portion 16 may sometimes be referred to as a cover or lid. Lower housing portion 14 may sometimes be referred to as a base.

Device 10 may be provided with any suitable number of antennas. There may be, for example, one antenna, two antennas, three antennas, or more than three antennas, in device 10. Each antenna may handle communications over a single communications band or multiple communications bands. In the example of FIG. 1, device 10 is shown as including an antenna such as antenna 22.

Device 10 may have integrated circuits such as a microprocessor. Integrated circuits may also be included in device 10 for memory, input-output functions, etc. Circuitry such as this is sometimes referred to collectively as control circuitry or logic circuitry.

Circuitry in device 10 such as integrated circuits and other circuit components may be located in lower housing portion 14. For example, a main logic board (sometimes referred to as a motherboard) may be used to mount some or all of this circuitry. The main logic board circuitry may be implemented using a single printed circuit board or multiple printed circuit boards. Printed circuit boards in device 10 may be formed from rigid printed circuit board materials or flexible printed circuit board materials. An example of a rigid printed circuit board material is fiberglass-filled epoxy. An example of a flexible printed circuit board material is polyimide. Flexible printed circuit board structures may be used for mounting integrated circuits and other circuit components and may be used to form communications pathways in device 10. Flexible printed circuit board structures such as these are sometimes referred to as "flex circuits."

If desired, wireless communications circuitry such as transceiver circuitry for supporting operations with antenna 22 may be mounted on a radio-frequency module associated with antenna 22. As shown in FIG. 1, a communications path such as path 24 may be used to interconnect antenna 22 and transceiver circuitry on the radio-frequency module to circuitry 28 in lower housing portion 14. Path 24 may be implemented, for example, using a cable or a flex circuit that is connected to the radio-frequency module associated with antenna 22.

Circuitry 28 may include wireless communications circuitry and other processing circuitry. This circuitry may be associated with a main logic board (motherboard) in lower housing 14 (as an example). Analog radio-frequency antenna signals and/or digital data associated with antenna 22 may be conveyed over path 24. An advantage to locating radio-frequency transceiver circuitry in the immediate vicinity of antenna 22 is that this allows data to be conveyed between the motherboard in housing portion 14 and antenna 22 digitally without incurring radio-frequency transmission line losses along path 24.

Device 10 may use antennas such as antenna 22 to handle communications over any communications bands of interest. For example, antennas and wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5 GHz band that is sometimes used for Wi-Fi communications, the 1575 MHz Global Positioning System band, and 2G and 3G cellular telephone bands. These bands may be covered using single-band and multiband antennas. For example, cellular telephone communications can be handled using a multiband cellular telephone antenna. A single band antenna may be provided to handle Bluetooth® communications. Antenna 22 may, as an example, be a multiband antenna that handles local area network data communications at 2.4 GHz and 5 GHz (e.g., for IEEE 802.11 communications). These are merely examples. Any suitable antenna structures may be used to cover any communications bands of interest.

As shown in FIG. 1, a hinge mechanism such as hinge 38 may be used to attach cover 16 to base 14. Hinge 38 may allow cover 16 to rotate relative to base 14 about longitudinal hinge axis 40. If desired, other attachment mechanisms may be used such as a rotating and pivoting hinge for a tablet computer. Device 10 may also be implemented using a one-piece housing. In devices with two-piece housings, the hinge portion of the device may contain springs that form a clutch mechanism and may therefore sometimes be referred to as a clutch barrel. Antenna 22 and associated transceiver circuitry on a radio-frequency module may, if desired, be located within clutch barrel 38.

Device 10 may have a display such as display 20. Display 20 may be, for example, a liquid crystal display (LCD), an organic light emitting diode (OLED) display, or a plasma display (as examples). If desired, touch screen functionality may be incorporated into display 20. The touch screen may be responsive to user input. Display 20 may be mounted in upper housing 16 using a metal frame or other suitable support structures.

Device 10 may also have other input-output devices such as keypad 36, touch pad 34, and buttons such as button 32. Input-output jacks and ports 30 may be used to provide an interface for accessories such as a microphone and headphones. A microphone and speakers may also be incorporated into housing 12.

The edges of display 20 may be surrounded by a bezel 18. Bezel 18 may be formed from a separate bezel structure such as a plastic ring or may be formed as an integral portion of a cover glass layer that protects display 20. For example, bezel 18 may be implemented by forming an opaque black glass portion for display 20 or an associated cover glass piece. This type of arrangement may be used, for example, to provide upper housing 16 with an attractive uncluttered appearance.

When cover 16 is in a closed position, display 20 will generally lie flush with the upper surface of lower housing 14. In this position, magnets on cover 16 may help hold cover 16 in place. Magnets may be located, for example, behind bezel portion 18.

Housing 12 may be formed from any suitable materials such as plastics, metals, glass, ceramic, carbon fiber, composites, combinations of plastic and metal, etc. To provide good durability and aesthetics, it is often desirable to use metal to form at least the exterior surface layer of housing 12. Interior portions such as frames and other support members may be formed from plastic in areas where light weight and radio-frequency transparency are desired and may be formed from metal in areas where good structural strength is desirable. In configurations in which an antenna such as antenna 22 is located in clutch barrel 38, it may be desirable to form the cover portion of clutch barrel 38 from a dielectric such as plastic, as this allows radio-frequency signals to freely pass between the interior and exterior of the clutch barrel.

Particularly in devices in which cover 16 and lower housing portion 14 are formed from metal, it can be challenging to properly locate antenna structures. Antenna structures that are blocked by conductive materials such as metal will not generally function properly. An advantage of locating at least some of the antenna structures for device 10 in clutch barrel 38 is that this portion of device 10 can be provided with a dielectric cover without adversely affecting the aesthetics of device 10. There is generally also sufficient space available within a laptop clutch barrel for an antenna and associated transceiver circuitry, because it can be difficult to mount other device components into this portion of device 10.

If desired, device 10 may be provided with multiple antennas. For example, an antenna for wireless local area network applications (e.g., IEEE 802.11) may be provided within clutch barrel 38 while a Bluetooth® antenna may be formed from a conductive cavity that is located behind bezel region 18 (as an example). Additional antennas may be used to support cellular telephone network communications (e.g., for 2G and 3G voice and data services) and other communications bands.

An antenna such as a clutch barrel antenna may be formed from a single antenna element. In some situations, it may be advantageous to form antennas for devices such as device 10 using multiple antenna elements. For example, a clutch barrel antenna may be formed from two antenna elements, three antenna elements, more than three antenna elements, etc. Antennas such as these are sometimes referred to as antenna arrays, antenna systems, antenna structures, or multielement antennas.

As an example, a clutch barrel antenna may be formed from first and second antenna elements. The first and second antenna elements may be arranged at different positions along longitudinal axis 40 of clutch barrel 38. This type of configuration is shown in FIG. 1. As shown in FIG. 1, antenna 22 may be formed from a first antenna element such as antenna element 22A and a second antenna element 22B. Each of these antenna elements may, if desired, serve as a stand-alone antenna. Because these elements are typically used in applications in which they work together as part of a larger antenna array, antennas such as antennas 22A and 22B are sometimes referred to herein as antenna elements or antenna structures. The antenna structures of antenna 22 include resonating element portions and ground portions.

Antennas that are formed from multiple antenna elements such as elements 22A and 22B may be used, for example, to implement multiple-input-multiple-output (MIMO) applications. Particularly in arrangements such as these, it may be desirable to form antennas that are not identical. Differences in polarization, gain, spatial location, and other characteristics may help these antennas operate well in an array. Differences such as these may also help to balance the operation of the overall antenna that is formed from the elements. For example, if antenna elements 22A and 22B have electric field polarizations that are distributed differently, the overall directivity of antenna 22 may be minimized. If antennas are too directive in nature, they may not function properly for certain applications. Antennas formed from elements 22A and 22B that exhibit different antenna characteristics may exhibit reduced directivity, allowing these antennas to be used in desired applications while complying with regulatory limits.

Antenna elements that exhibit desired differences in their operating characteristics such as their electric-field polarization distribution and gain distribution may be formed by ensuring that the sizes and shapes of the conductive elements that make up each of antenna elements are sufficiently different from each other. Antenna element differences may also be implemented by using different dielectric loading schemes for each of the elements. Antenna elements may also be made to perform differently by orienting elements differently (e.g., at right angles to each other).

Antenna elements that exhibit different operating characteristics can also be implemented using different antenna designs. For example, one antenna element may be implemented using a planar inverted-F antenna design and another antenna may be implemented using a slot antenna architecture. Examples of antenna types that may be used for the antenna elements in antenna 22 include inverted-F antenna elements such as a single-arm or multiple arm elements, planar inverted-F antenna elements (e.g., planar inverted-F antenna elements with one or more planar arms), slot antennas (e.g., slot antennas having closed and/or open slots of similar or dissimilar lengths), or a hybrid antenna (e.g., a hybrid antenna that includes a slot and a planar-inverted-F antenna resonating element arm or that includes a slot and an inverted-F resonating element). Element 22A may be formed from one of these structures and element 22B may be formed from a different one of these structures (as an example).

Figure 2:
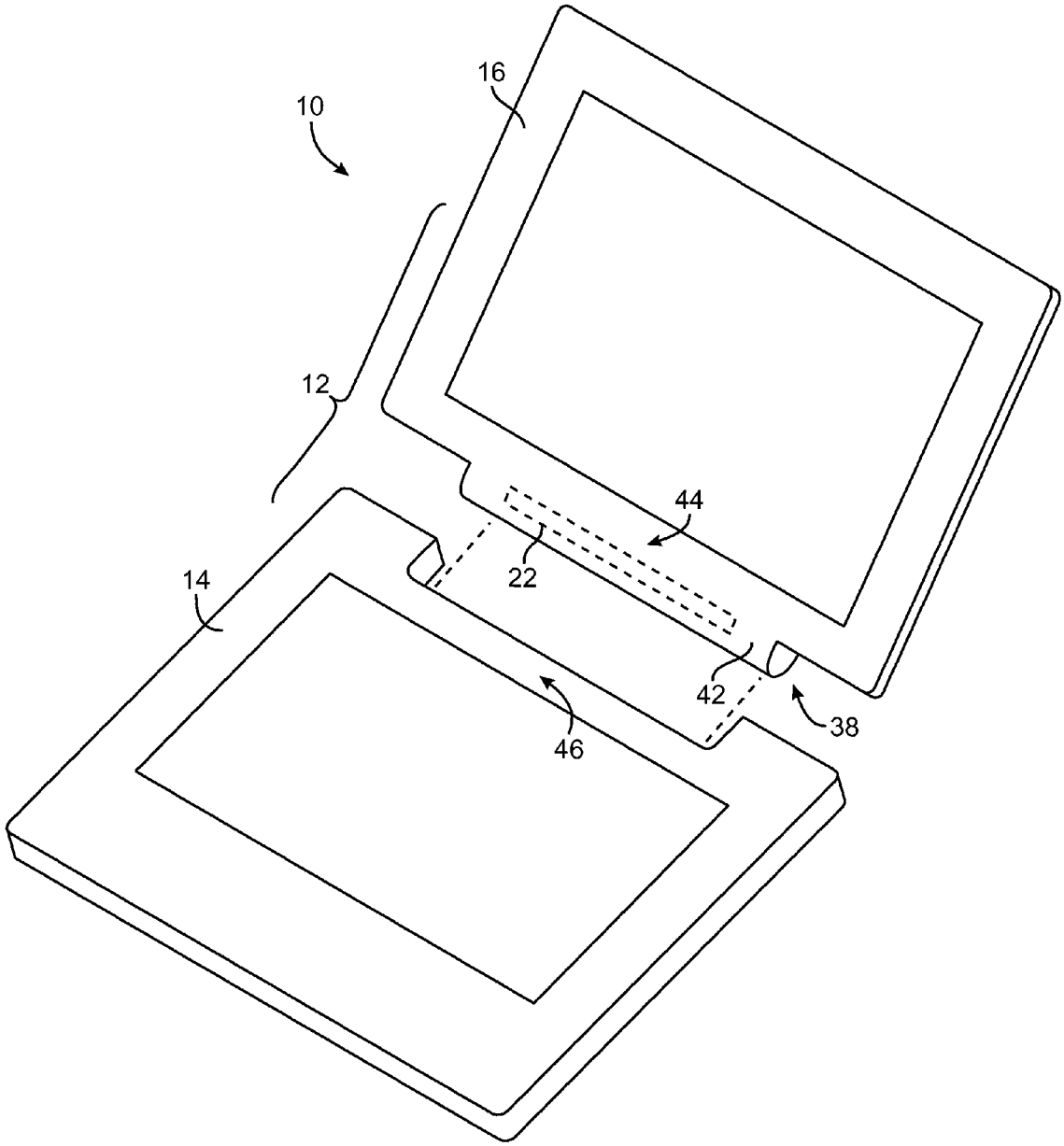
FIG. 2 is an exploded perspective view of an illustrative laptop computer having a housing portion such as a clutch barrel in which antenna and transceiver structures may be located in accordance with an embodiment of the present invention.

As described in connection with FIG. 1, antenna 22 and associated transceiver circuitry may be located in the clutch barrel portion of a portable computer. As shown in the exploded diagram of FIG. 2, clutch barrel 38 of device 10 may be provided with outer surface 42. Outer surface 42 may be formed entirely or partly from a dielectric such as plastic. This type of arrangement may be used to ensure that outer surface 42 does not block radio-frequency antenna signals. If desired, nearby portions of device 10 such as portion 44 of upper housing 16 and portion 46 of lower housing 14 can be formed from conductive materials.

Clutch barrel cover 42 may be formed from a unitary (one-piece) structure or may be formed from multiple parts. Clutch barrel cover 42 may have any suitable shape. For example, surface 42 may be substantially cylindrical in shape. Surface 42 may also have other shapes such as shapes with planar surfaces, shapes with curved surfaces, shapes with both curved and flat surfaces, etc. In general, the shape for the outer surface of clutch barrel 38 may be selected based on aesthetics, so long as the resulting shape for clutch barrel 38 does not impede rotational movement of upper housing portion 16 relative to lower housing portion 14 about clutch barrel longitudinal axis 40 (FIG. 1).

Clutch barrel arrangements in which radio-frequency transceiver circuitry is mounted adjacent to antenna 22 can improve radio-frequency performance for device 10 by reducing transmission line signal losses. This is because the length of the transmission line paths between the transceiver circuitry and antenna 22 can be minimized.

Figure 3:
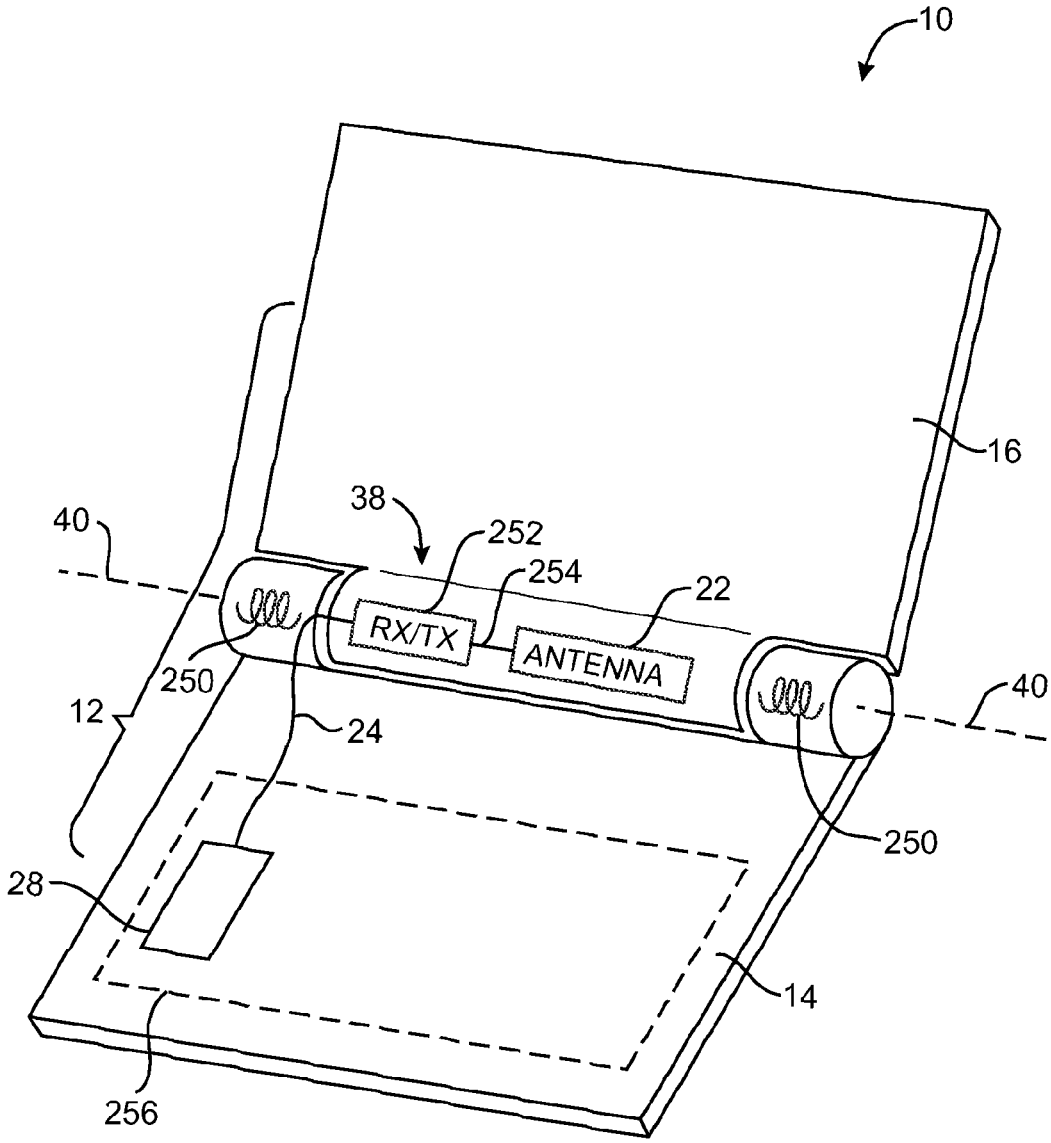
FIG. 3 is a perspective view an illustrative antenna and transceiver mounted within the clutch barrel of a portable electronic device such as a laptop computer in accordance with an embodiment of the present invention.

An illustrative clutch barrel configuration in which transceiver circuitry is mounted in the vicinity of antenna 22 in clutch barrel 38 is shown in FIG. 3. As shown in FIG. 3, clutch barrel 38 may have associated springs such as springs 250 that form part of the hinge mechanism for device 10. Transceiver circuitry 252 may be located within clutch barrel 38 between springs 250. Transceiver circuitry 252 may include one or more wireless communications circuits such as radio-frequency input amplifiers (sometimes referred to as low-noise amplifiers) and radio-frequency output amplifiers (sometimes referred to as power amplifiers), integrated circuits that handle modulation and demodulation operations, communications chips, discrete components such as inductors, capacitors, and resistors, etc. Transceiver circuitry 252 may be implemented by mounting components to a printed circuit board or other suitable carrier. In arrangements such as these, the components in transceiver circuitry 252 and the substrate to which they are mounted form a radio-frequency module or assembly. Transceiver circuitry 252 may therefore sometimes be referred to as a radio-frequency module or radio-frequency assembly.

Radio-frequency transmission line path 254 may be used to convey radio-frequency signals from antenna elements in antenna 22 to transceiver circuitry 252. Radio-frequency transmission line path 254 may also be used to convey radio-frequency signals to the antenna elements in antenna 22 from transceiver circuitry 252. Any suitable transmission line structures may be used to form path 254. For example, path 254 may include one or more coaxial cables, one or more microstrip transmission lines, combinations of coaxial cables and microstrip transmission lines, or other suitable paths that can carry radio-frequency signals between transceiver circuitry 252 and antenna 22.

Transceiver circuitry 252 may communicate with circuitry 28 on one or more printed circuit boards such as motherboard 256 in main housing portion 14 using communications paths such as path 24. Circuitry 28 may include logic circuitry for transmitting and receiving digital data (as an example). For example, circuitry 28 may include one or more communications integrated circuits that provide data to transceiver circuitry 252 over path 24 in digital form that is to be transmitted by transceiver circuitry 252 and antenna 22. When operating as a receiver, transceiver circuitry 252 may receive incoming radio-frequency signals from antenna 22 and may convert these signals into received data in digital form. This data may be passed to circuitry 28 over path 24 as digital data. The digital data that is conveyed over path 24 may be, for example, data in a 2.4 GHz digital data stream or a data stream at any other suitable data rate.

An advantage to the arrangement of FIG. 3 is that it helps to minimize transmission line losses. Transmission line losses in conventional systems can be associated with non-negligible reductions in performance. For example, coaxial cable transmission lines can introduce losses on the order of 3 dB per meter. It is not uncommon for coaxial cable transmission line losses in a laptop computer to reach 1.5 dB. Transmission line losses of this magnitude can adversely affect performance during signal transmission and signal reception activities.

When signals are transmitted, radio-frequency transmission line losses reduce transmitted power levels. If the power of a transmitted radio-frequency signal is too low, the signal will not be received properly by the equipment with which it is communicating. Although power levels can generally be raised by increasing the output power of the power amplifier that is feeding the antenna, this can waste power and lead to increased noise levels.

Transmission line losses also affect signal quality for incoming signals. After radio-frequency signals are received by the antenna, these signals must traverse a length of transmission line before reaching the input of the low noise amplifier in the transceiver. If transmission line losses are large, the power of the incoming signal can be significantly reduced. Although the gain of the low noise amplifier can be increased to compensate for low power signals, the signal-to-noise ratio of the received signal will be adversely affected by the transmission line losses.

With arrangements of the type shown in FIG. 3 in which transceiver circuitry 252 and antenna 22 are located within clutch barrel 38, the length of the transmission lines in transmission line path 254 can be minimized. Reductions in the length of path 254 help to reduce transmission line losses and therefore improve signal quality (e.g., signal-to-noise ratio).

Because path 24 carries digital data and not analog radio-frequency signals, signal losses on path 24 are less important than the radio-frequency signal losses incurred on path 254. So long as path 24 is able to carry the digital data without excessive levels of noise, performance will not be adversely affected, even if the length of path 24 is significant.

Digital data communications schemes for path 24 may also implement features that help accommodate signal degradation. For example, error correction features may be implemented for path 24. These error correction features may involve the use of error correction codes (e.g., cyclic redundancy check codes), the use of data retransmission schemes when errors are detected, the use of signal preemphasis and other signal conditioning techniques, or other arrangements for ensuring high-quality data transmission. Digital data communications functions for transmitting and receiving data over path 24 may be implemented using hardware and/or software. For example, if it is desired to use error correction coding on the data being conveyed over path 24, the digital data transmitter and receiver circuits associated with transmitter circuitry 252 and circuitry 28 may be provided with error correction circuitry (as an example).

Although digital data schemes are typically preferred, path 24 may, if desired, be used to carry analog data signals. The use of arrangements in which path 24 is used to carry digital data is generally described herein as an example.

Data may be conveyed over path 24 at any suitable data rate. Path 24 may include one or more serial data paths or one or more parallel paths. An example of a data communications arrangement that uses parallel bus paths is the Peripheral Component Interface (PCI) standard. An example of a data communications arrangement that uses serial paths is the Peripheral Component Interconnect Express (PCIE) standard. Communications links such as PCIE links contain multiple serial paths called lanes. For example, a 1 GB/s PCIE link can be formed from four 250 MB/s lanes operating in parallel. Path 24 may be formed from one or more PCIE lanes, may be formed from a parallel bus (e.g., a PCI bus), or may be formed using any other suitable communications link arrangement. Digital data communications circuits in the circuitry at both ends of path 24 may be used to handle multiple lanes of digital data signals.

For example, circuitry 28 may include communications chips (e.g., a communications integrated circuit for conveying data over path 24), a microprocessor, memory, input-output circuits, and other discrete circuits and integrated circuits that can handle multiple lanes of digital data. Circuitry 28 may be mounted on a support structure such as motherboard 256. Motherboard 256 may be implemented using a single printed circuit structure or using multiple structures. For example, one or more rigid printed circuit boards may be used to mount and interconnect components in circuitry 28. If desired, flex circuits may be used to interconnect some or all of circuitry 28.

Figure 4:
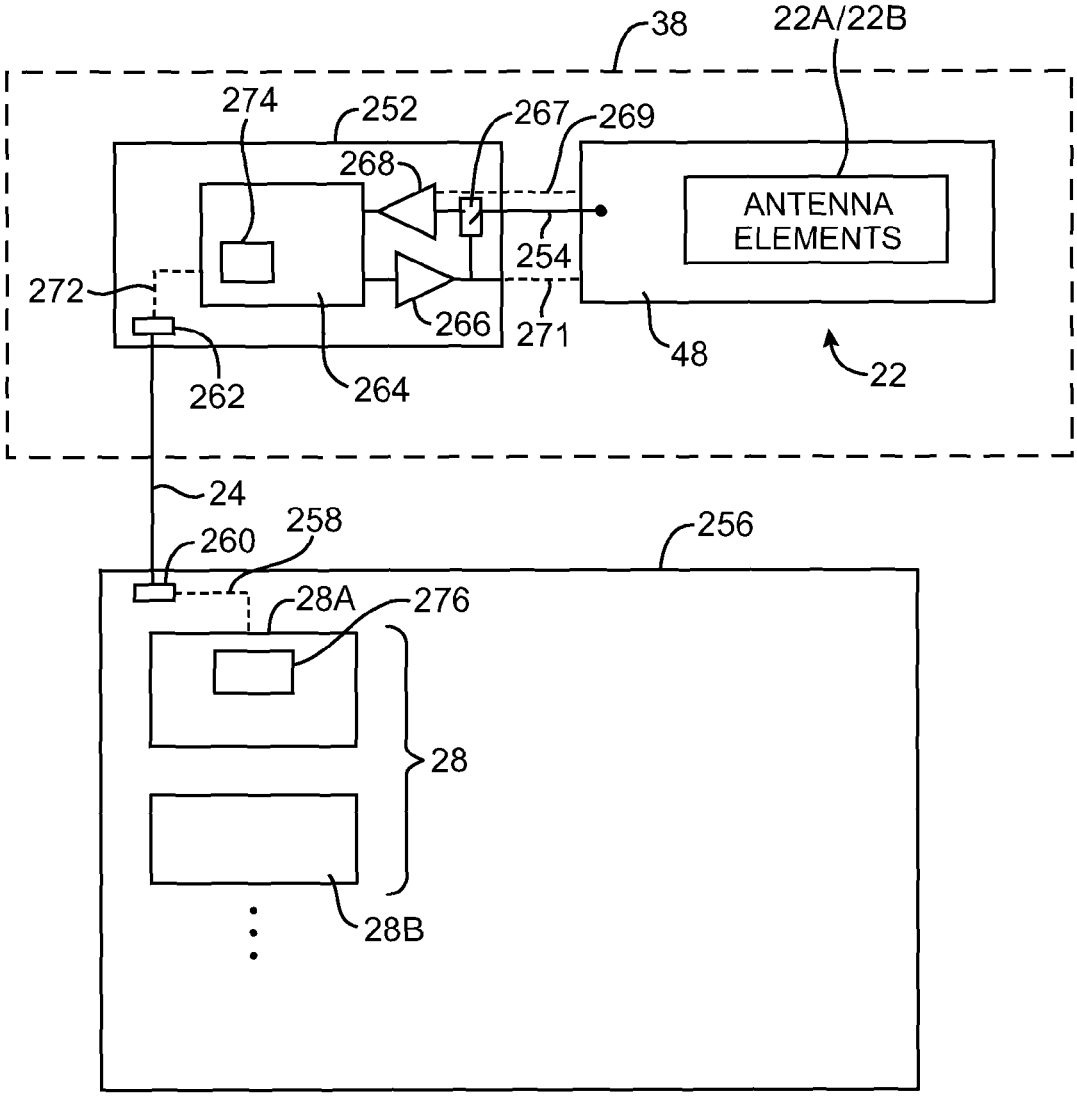
FIG. 4 is a circuit diagram of an illustrative antenna and transceiver coupled to circuitry on a main logic board in accordance with an embodiment of the present invention.

FIG. 4 shows circuitry that may be used in device 10. As shown in FIG. 4, circuitry 28 may be made up of one or more circuits such as circuits 28A, 28B, etc. Circuits such as circuits 28A and 28B may be integrated circuits. One or more of the circuits in circuitry 28 may include digital data communications circuitry 276. Data communications circuitry 276 may be used to send and receive digital data over path 24. Signals may be conveyed between circuit 276 and path 24 over path 258 on board 256 (as an example). A connector such as connector 260 may be used in connecting cables in path 24 to board 256. Connector 260 may be, for example, a PCI Express connector that mates with a ribbon cable or other cable in path 24.

In clutch barrel 38, transceiver circuitry 252 may have an associated connector such as connector 262. Cables in path 24 may be connected to a circuit board in circuitry 252 using connector 262. Connector 262 may be, for example, a PCI Express connector. A path such as path 272 may be used to interconnect connector 262 with digital data communications circuitry 274. Digital data communications circuitry 274 may be implemented using a stand-alone integrated circuit or may be implemented as part of transceiver integrated circuit 264. Transceiver integrated circuit 264 may convert received digital data signals from path 24 into radio-frequency signals for transmission over antenna 22. Received radio-frequency signals from antenna 22 may be converted by transceiver integrated circuit 264 into digital data. This digital data may be conveyed to circuitry 28 using digital data communications circuitry 274.

Transceiver circuitry 264 may be implemented using a single integrated circuit, using multiple integrated circuits, using discrete components, using combinations of these arrangements, or using any other suitable circuits. This circuitry may use one or more input and output radio-frequency amplifiers for amplifying radio-frequency signals. Low-noise amplifier 268 may serve as an input amplifier that receives radio-frequency signals from antenna 22 over transmission line path 254. Transmitted radio-frequency signals that are produced by transceiver 264 may be amplified by a power amplifier such as output radio-frequency amplifier 266. Amplified output signals from amplifier 266 may be provided to antenna 22 using transmission line path 254. In the example of FIG. 4, amplifiers 268 and 266 have been implemented using components that are separate from transceiver integrated circuit 264. This is merely illustrative. Amplifiers such as amplifier 268 and 266 may, if desired, be implemented as part of transceiver circuit 264.

Antenna 22 may be formed from one or more antenna elements such as elements 22A and 22B. As indicated by dashed lines 269 and 271, amplifiers such as amplifiers 268 and 266 may be individually connected to respective antenna elements in antenna 22. For example, one antenna element in antenna 22 may be used to receive radio-frequency signals. This antenna element may be connected to input amplifier 268 using radio-frequency transmission line input path 269. Another antenna element in antenna 22 may be used in transmitting radio-frequency signals. This antenna element may be connected to the output of output amplifier 266 using path 271. This type of arrangement allows outgoing traffic to be transmitted by output amplifier 266 at the same time that incoming traffic is being received by input amplifier 268, provided that the antenna elements are sufficiently isolated from each other.

It may be advantageous for amplifiers 266 and 268 to share antenna circuitry. Sharing arrangements avoid duplicative antenna structures and thereby help to minimize the amount of space required for antenna 22. When antenna sharing arrangements are used, care should be taken to avoid coupling output signals from the output of output amplifier 266 into the input of amplifier 268 when amplifier 268 is active. Conflicts between incoming and outgoing traffic can be avoided using directional couplers, frequency multiplexing techniques, time multiplexing techniques, or other suitable arrangements.

As shown in FIG. 4, for example, circuitry such as circuit element 267 may be interposed between amplifiers 266 and 268 and antenna structures 22. Circuitry 267 may be implemented using an individual circuit component, a network of circuit components, or any other suitable arrangement.

With one suitable arrangement, circuitry 267 may include a switch such as a high-speed solid state switch. The state of the switch can be controlled by control signals from circuitry 252. When it is desired to transmit radio-frequency signals from the output of amplifier 266, the switch in circuitry 267 may be placed in a configuration in which the output of amplifier 266 is connected to path 254. In this configuration, output signals can be transmitted through antenna 22, but input signals cannot be received. When it is desired to receive input signals, the state of the switch in circuitry 267 can be configured to connect the input of input amplifier 268 to transmission line path 254. Input signals can be received while the switch is configured in this way, but output signals will be blocked. To accommodate both input and output signals, the switch may be switched back and forth between its input and output configurations as needed. Input and output functions can be associated with alternating time slots of equal length or switch 267 can be configured to form input and output paths on demand according to control signals. These time-division multiplexing schemes may be used to allow amplifier 268 and 266 to share a common antenna 22.

Another suitable antenna sharing arrangement involves the use of a circulator in circuitry 267. A circulator may have first, second, and third ports. Signals received at the first port will be routed to the second port. Signals received at the second port will be routed to the third port. Similarly, signals that are provided to the third port will be directed towards the first port. The first, second, and third ports of the circulator may be connected, respectively, to the output of amplifier 266, transmission line path 254, and the input of amplifier 268. With this type of circuitry 267, incoming radio-frequency signals from antenna 22 will be directed to the input of amplifier 268 without coupling power to the output of amplifier 266 and outgoing signals from the output of amplifier 266 will be directed to transmission line 254 without coupling power to the input of amplifier 268.

As an alternative to using a circulator, circuitry 267 may be provided with a duplexer. A duplexer can be designed to implement a directional coupler scheme. Amplifier 266 may be associated with a first coupler port and amplifier 268 may be associated with a second coupler port. The first and second ports can be isolated from each other. A duplexer can also be designed to implement a frequency sharing scheme. As an example, certain sub-bands in a communications band may be exclusively associated with data transmission operations and other sub-bands in the communications band may be exclusively associated with data reception operations. The duplexer in this type of arrangement will route signals based on their frequencies, so outgoing signals will be routed to antenna 22 without coupling power into the input of amplifier 268, whereas incoming signals will be routed to the input of amplifier 268 without coupling power into the output of amplifier 266.

Antenna elements in antenna 22 such as antenna elements 22A and 22B may be mounted on an antenna support structure such as support structure 48. Antenna support structure 48 may be formed from a dielectric such as plastic to avoid blocking radio-frequency signals from antenna 22. Antenna elements in antenna 22 may, if desired, be formed from flex circuits. With this type of arrangement, each antenna element may be formed from a flex circuit with a different pattern of conductive traces. These flex circuit elements may be mounted to antenna support structure 48. Conductive transmission line pathways may be used to interconnect the antenna elements with transceiver circuitry 252. By mounting antenna 22 adjacent to transceiver circuitry 252, the length of the transmission line paths between transceiver circuitry 252 and antenna 22 may be minimized (e.g., to be less than 20 cm, to be less than 10 cm, to be less than 5 cm, etc.).

Figure 5:
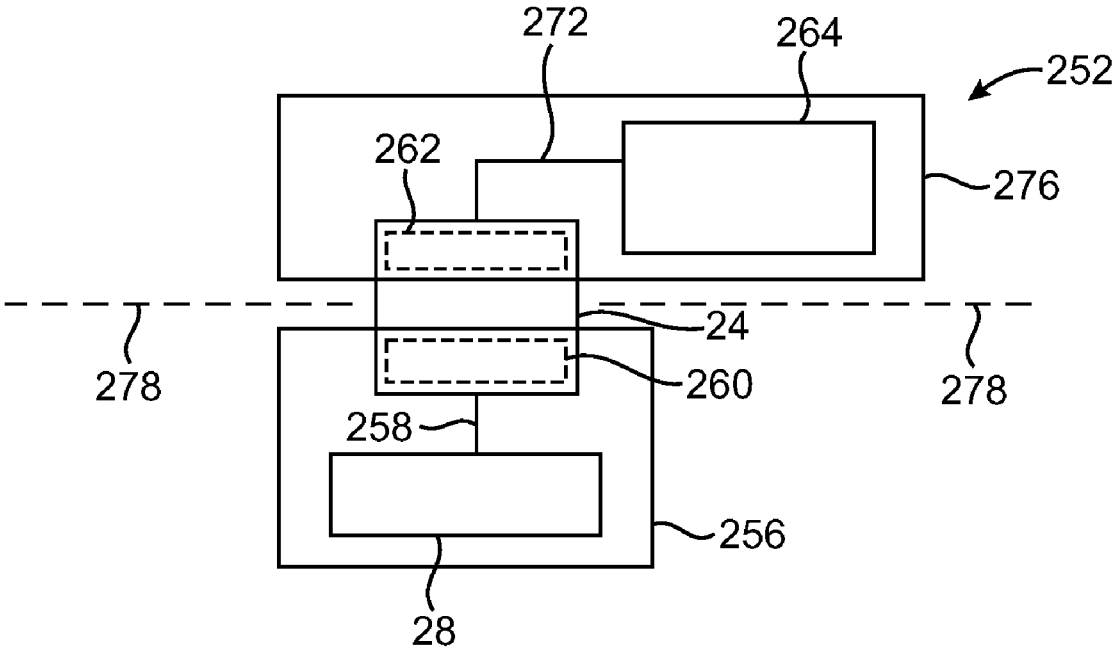
FIG. 5 is a diagram showing how a flexible communications path such as a flex circuit path can be used to interconnect a transceiver and control circuitry in a portable electronic device in accordance with an embodiment of the present invention.

If desired, some or all of path 24 may be implemented using flex circuits. An example of this type of arrangement is shown in FIG. 5. In the FIG. 5 configuration, path 24 is formed from traces on a flex circuit. The flex circuit may flex about axis 278. For example, flex circuit path 24 may bend about axis 278 as a user opens and closes lid 16 of device 10 and thereby causes lid 16 to rotate about axis 40 relative to base 14. As shown in FIG. 5, circuitry 28 may be mounted to board 256 and connected to flex circuit path 24 by path 258 and connector 260. Connector 262 on board 276 may be connected to the opposing end of flex circuit path 24. Path 272 may be used to interconnect connector 262 to transceiver circuitry such as circuitry 264. Board 276 may be mounted in clutch barrel 38 (FIG. 3).

Figure 6:
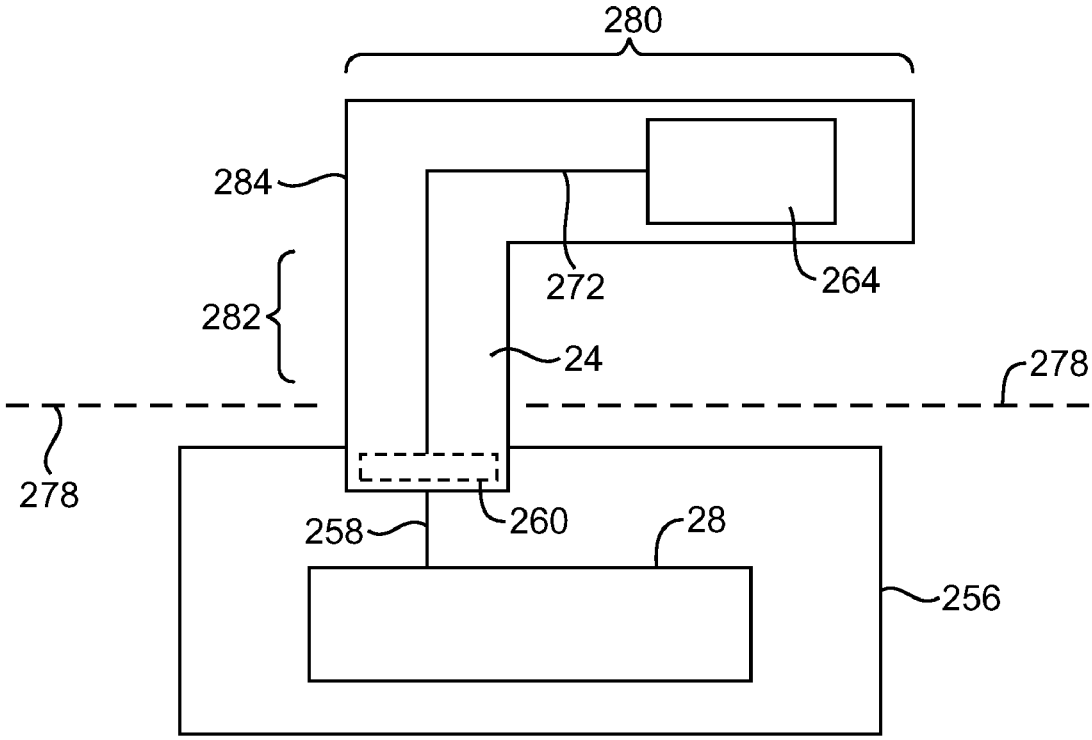
FIG. 6 is a diagram showing how a flexible communications path such as a flex circuit path can be used in mounting a transceiver and can be used to interconnect a transceiver with circuitry in another portion of a wireless electronic device in accordance with an embodiment of the present invention.

Another illustrative configuration is shown in FIG. 6. In the FIG. 6 arrangement, transceiver circuitry 264 (e.g., one or more transceiver integrated circuits) has been mounted directly to flex circuit substrate 284. Portion 280 of flex circuit 284 therefore serves as a mounting structure for circuitry 264 and may contain traces to form communications path 272. Portion 282 of flex circuit 284 contains traces that form communications path 24. As with the arrangement of FIG. 5, flex circuit path 24 may flex about axis 278 when cover 16 is rotated relative to base 14 in device 10. Flex circuit 24 may be connected to circuitry 28 on motherboard 256 using connector 260 and path 258.

Figure 7:
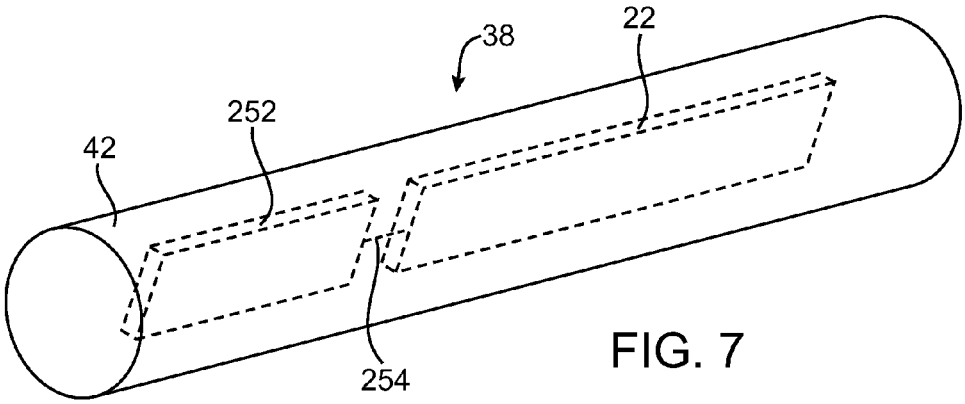
FIG. 7 is a perspective view of an illustrative antenna and transceiver mounted within a compact portion of an electronic device housing such as the clutch barrel of a portable computer in accordance with an embodiment of the present invention.

FIG. 7 shows how transceiver circuitry 252 may be mounted within clutch barrel 38 adjacent to antenna 22. Clutch barrel cover 42 may surround transceiver circuitry 252 and antenna 22. Transmission line path 254 may be used to convey signals between transceiver circuitry 252 and antenna 22. Antenna structure 22 may include one, two, or more than two antenna elements such as elements 22A and 22B.

Figure 8:
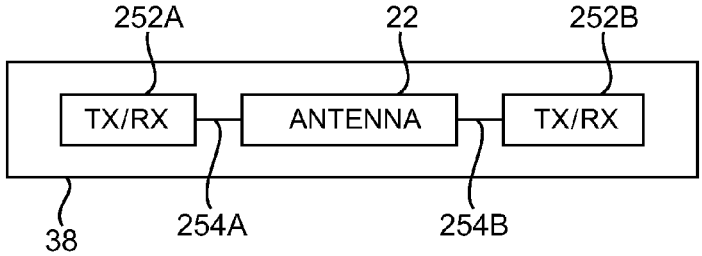
FIG. 8 is a diagram showing how an antenna may be located between two transceivers in a clutch barrel of a portable electronic device in accordance with an embodiment of the present invention.

In the example of FIG. 7, transceiver 252 is located at one end of clutch barrel 38 and antenna 22 is located at the other end of clutch barrel 38. If desired, antenna 22 may be located between two or more transceiver circuits, as shown in FIG. 8. In the example of FIG. 8, antenna 22 is located between transceiver 252A and transceiver 252B. Transmission line path 254A may be used to interconnect transceiver circuitry 252A with antenna 22. Transmission line path 254B may be used to interconnect transceiver circuitry 252B with antenna 22. Transceivers 252A and 252B may, for example, be associated with respective antenna elements in antenna 22.

Figure 9:
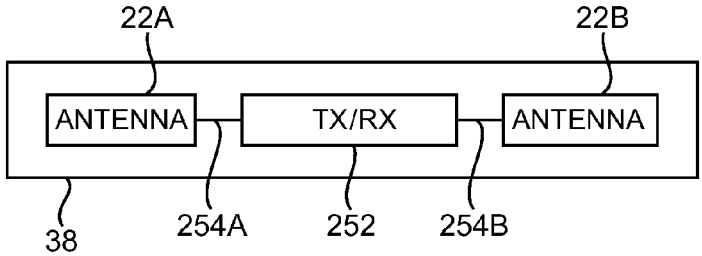
FIG. 9 is a diagram showing how a transceiver may be located between two antennas in a clutch barrel of a portable electronic device in accordance with an embodiment of the present invention.

As shown in FIG. 9, arrangements in which transceiver circuitry 252 is located between antenna elements in clutch barrel 38 may also be used. In the FIG. 9 example, transceiver circuitry 252 is connected to antenna element 22A by transmission line path 254A. Transceiver circuitry 252 may be connected to antenna element 22B by transmission line path 254B. Paths such as transmission line path 254 of FIG. 7 and paths 254A and 254B of FIGS. 8 and 9 may each be formed from one or more coaxial cables, one or more microstrip transmission lines, or other transmission lines.

Transceiver circuitry 252 may be provided using one or more integrated circuits. These integrated circuits may each provide a different transceiver function (e.g., conversion between radio-frequency signals and digital data signals, amplification, etc.). Transceiver integrated circuits such as these may be mounted on in a radio-frequency module. An illustrative arrangement in which transceiver circuitry 252 has been implemented as a radio-frequency module is shown in FIG. 10.

Figure 10:
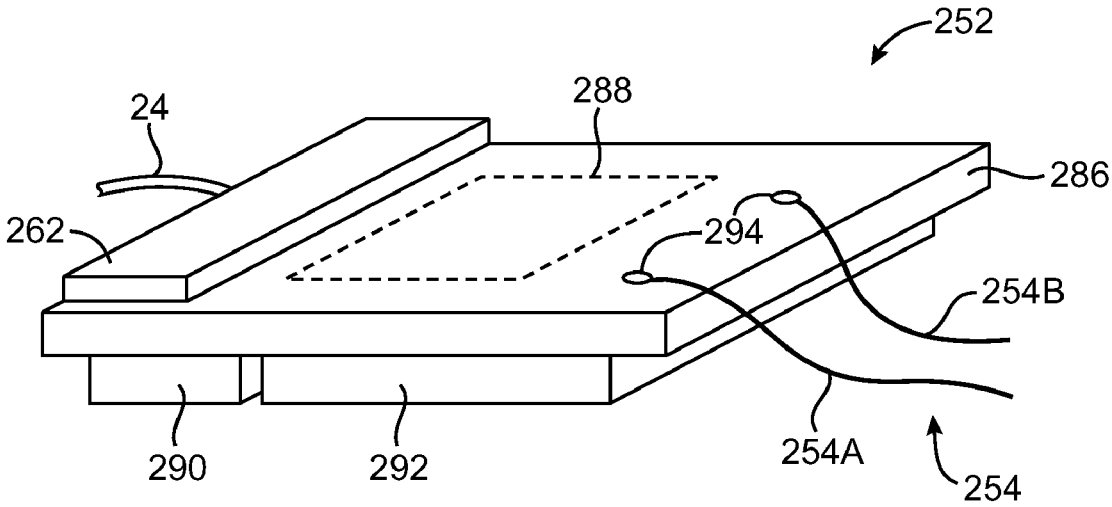
FIG. 10 is a perspective view of illustrative mounting structures that may be used in mounting clutch barrel transceiver circuitry in accordance with an embodiment of the present invention.

As shown in FIG. 10, the radio-frequency module for transceiver 252 may have a main support structure such as printed circuit board 286. Connector 262 may be used to attach communications path 24 to board 286. One or more integrated circuits for supporting transceiver functions may be mounted to board 286. In the FIG. 10 example, there are two such integrated circuits mounted to board 286. The first integrated circuit is mounted in electromagnetic interference shielding can 290. The second integrated circuit is mounted in electromagnetic interference shielding can 292. Additional shielding cans may be used to house additional integrated circuits if desired. Discrete components such as components 288 may also be mounted to board 286 in radio-frequency transceiver module 252. Coaxial cable connectors 294 such as UFL connectors may be connected to transmission line cables 254A and 254B in transmission line path 254 (as an example).

Clutch barrel antenna 22 may be formed from any suitable antenna structures such as stamped or etched metal foil, wires, printed circuit board traces, other pieces of conductor, etc. Conductive structures may be freestanding or may be supported on substrates. Examples of suitable substrates that may be used in forming antenna 22 include rigid printed circuit boards such as fiberglass-filled epoxy boards and flex circuits. In printed circuit boards and flex circuits, conductive traces may be used in forming antenna structures such as antenna resonating elements, ground structures, impedance matching networks, and feeds. These conductive traces may be formed from conductive materials such as metal (e.g., copper, gold, etc.).

An advantage of using flex circuits in forming antenna structures is that flex circuits can be inexpensive to manufacture and can be fabricated with accurate trace dimensions. Flex circuits also have the ability to conform to non-planar shapes. This allows flex circuit antenna elements to be formed that curve to follow the curved surface of clutch barrel surface 42.

Illustrative structures for implementing antenna 22 and for mounting transceiver circuitry 252 in clutch barrel 38 are shown in FIGS. 11, 12, 13, and 14.

Figure 11:
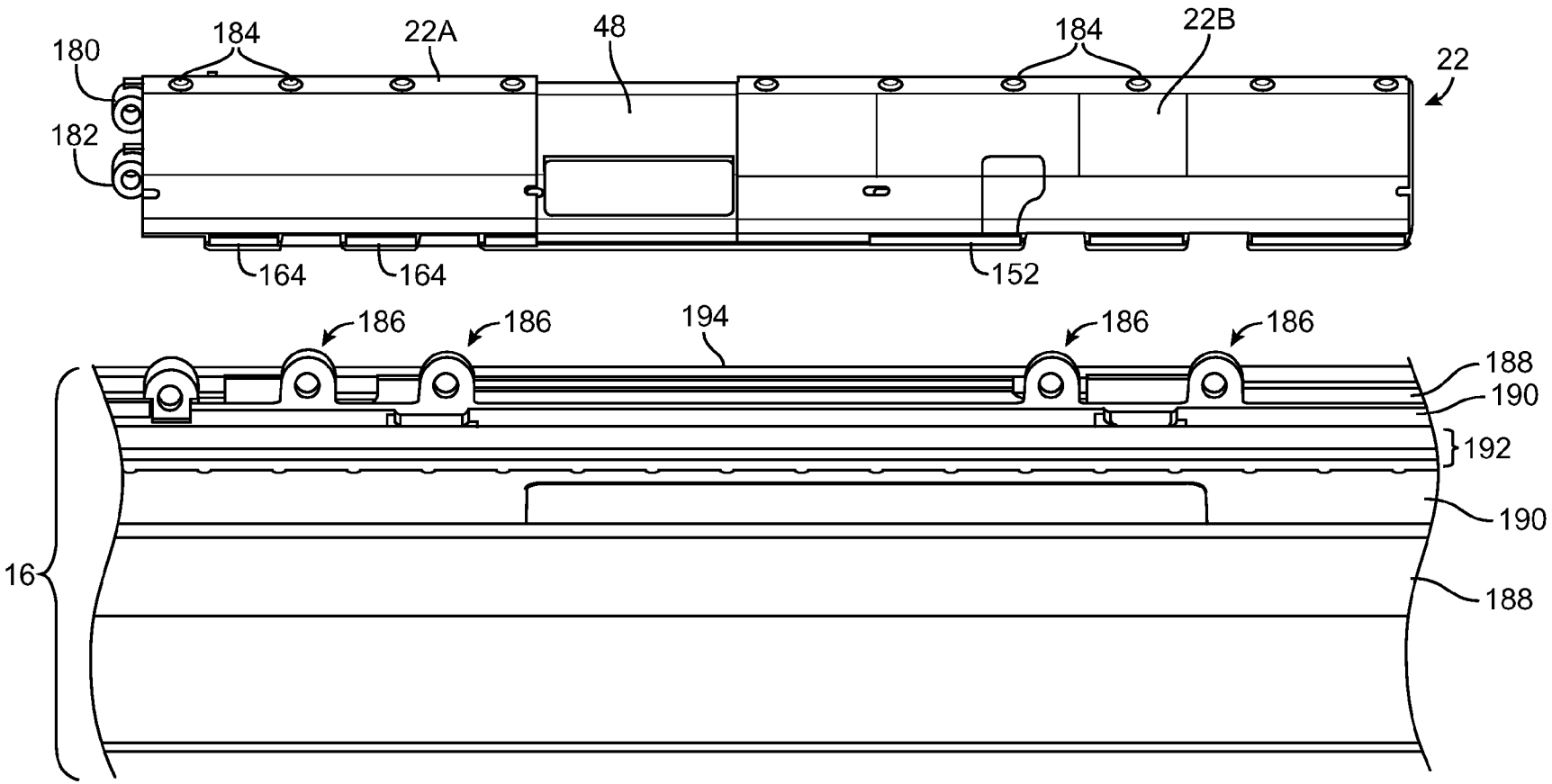
FIG. 11 is an exploded perspective view of a portion of a portable electronic device housing and associated clutch barrel antenna structures in accordance with an embodiment of the present invention.

An exploded perspective view of antenna 22 in the vicinity of housing portion 16 is shown in FIG. 11. As shown in FIG. 11, housing 16 may include a cover such as cover portion 188. Cover 188 may be a sheet of metal that serves as the outer cover layer for upper housing portion 16 (e.g., the lid of device 10). Metal support structures such as frame 190 may be mounted within metal layer 188. An elastomeric member such as gasket 192 may be mounted to frame 190. A display such as a liquid crystal display may be mounted in upper housing portion 16. When mounted, gasket 192 may help to prevent the display from bearing against edge 194 of housing layer 188 and the inner portion of frame 190. Because frame 190 may be used in mounting a display, frame 190 is sometimes referred to as a display frame.

Frame 190 may have holes 186 that mate with corresponding holes in antenna support 48. Coaxial cable connectors that are associated with transmission line path 254 may be connected to antenna 22 at attachment locations 180 and 182. The coaxial cable connectors may be, for example, UFL connectors. One connector (connector 180) may be connected to a first cable in transmission line path 254 such as cable 254A of FIG. 10. Another connector (connector 182) may be connected to a second cable in transmission line path 254 such as cable 254B of FIG. 10. Conductive foam or other suitable conductive structures may be used to ground antenna 22 to housing 16. For example, conductive foam at ground locations 164 and 152 may be used to ground antenna 22 to frame 190. Frame 190 may be shorted to case 188. Heat stakes 184 may be used to align flex circuits 22A and 22B to antenna support structure 48.

If desired, antenna support structure 48 may have ribbed internal support member or ribs may be formed as an integral portion of antenna support structure 48. Antenna support structure 48 may also be formed from multiple parts that are joined together (e.g., multiple plastic parts such as ribbed supports, support surfaces, etc.). Screw holes may be provided in antenna support structure 48. Screws may pass through the screw holes in support structure 48 and may be screwed into threads in screw holes 186 to secure support structure 48 to frame 190.

Figure 12:
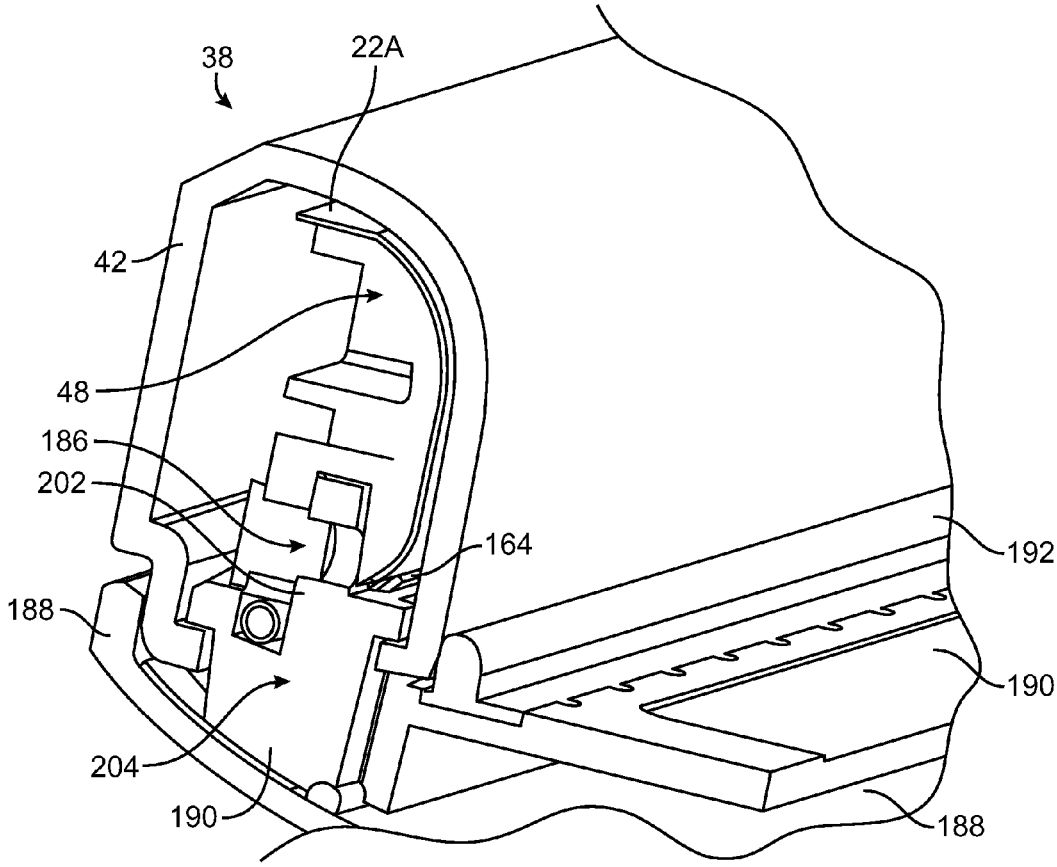
FIG. 12 is a cross-sectional end view of a portion of a clutch barrel in a portable computer that contains an antenna and transceiver in accordance with an embodiment of the present invention.

As shown in FIG. 12, the lower portion of clutch barrel cover 42 may have an opening such as opening 204 that runs along substantially the entire length of clutch barrel cover 42. Opening 204 allows conductive housing portions such as portions 202 of display frame 190 to protrude into the interior of clutch barrel 38. These conductive members may serve as antenna ground for antenna 22 and may be electrically connected to the conductive traces of the flex circuit antenna elements mounted to support 48 using conductive members such as conductive foam 164.

Figure 13:
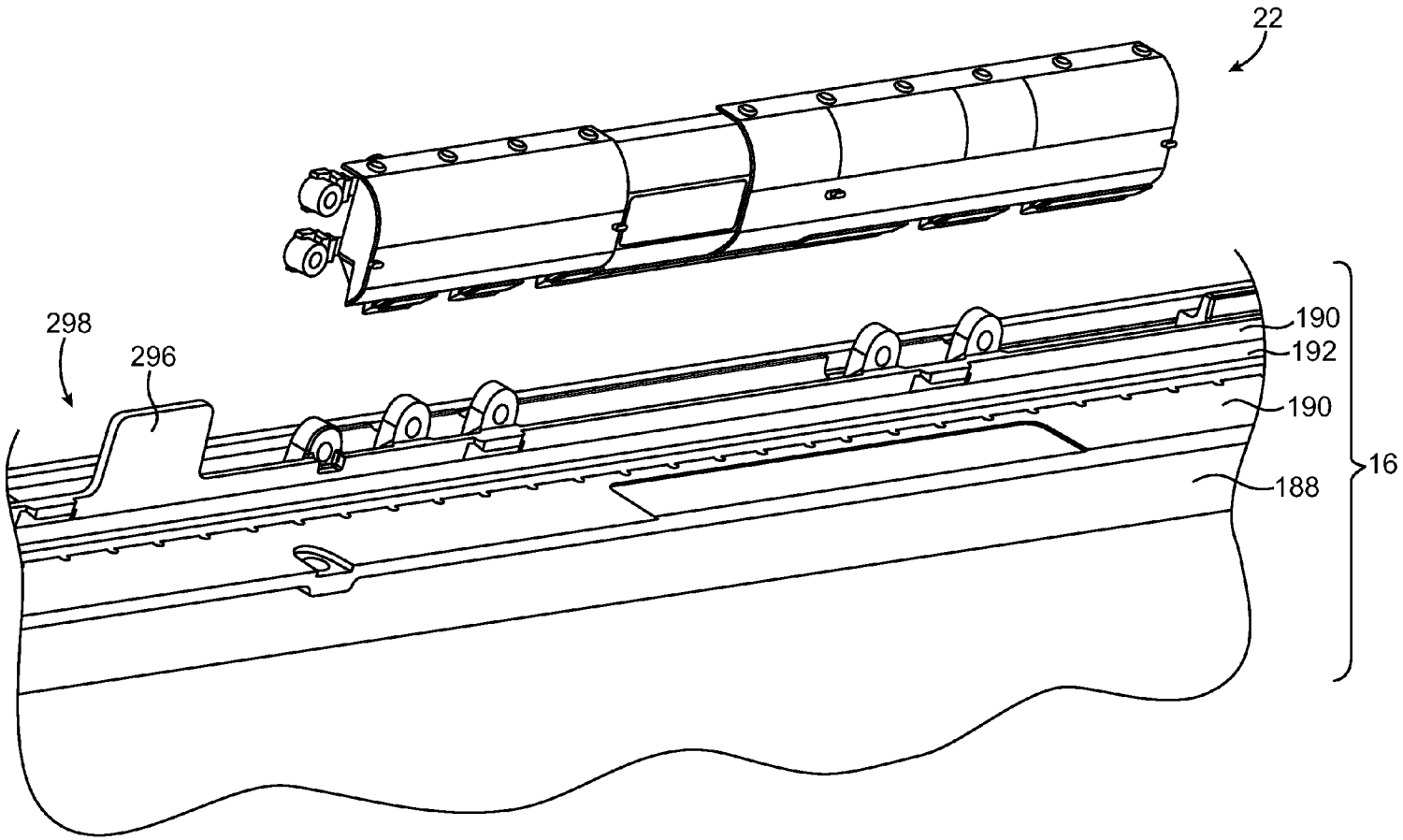
FIG. 13 is an exploded perspective view of a portion of a portable electronic device housing and clutch barrel antenna showing how the device housing may have a frame with an associated heat sink portion for a clutch barrel transceiver in accordance with an embodiment of the present invention.

As shown in FIG. 13, a heat sink structure such as heat sink 296 may be formed in housing 16. Transceiver circuitry 252 (FIG. 10) may be mounted in region 298 so that radio-frequency shielding cans such as cans 290 and 292 rest against heat sink 296. This helps draw heat away from the transceiver circuitry during operation. In the FIG. 13 example, heat sink 296 has been formed as an integral portion of frame 190 by forming a tab-shaped extension upward from housing 16 (in the orientation of FIG. 13). In this type of configuration, both frame 190 and extension 296 may be formed of metal.

If desired, heat sink 296 may be formed from a separate structure (e.g., a piece of metal that has been attached to frame 190 by welds or fasteners). Other arrangements may also be used. For example, a heat sink may be formed from portions of metal layer 188 or from a structure that is connected directly to metal layer 188. An advantage of forming a heat sink such as heat sink 296 as an integral portion of frame 190 is that this helps to avoid air gaps which might otherwise develop between separate metal pieces. Because air gaps are avoided, good thermal conduction may be ensured between heat sink 296 and housing 16 (frame 190) without the need for thermal compound (thermal paste).

Figure 14:
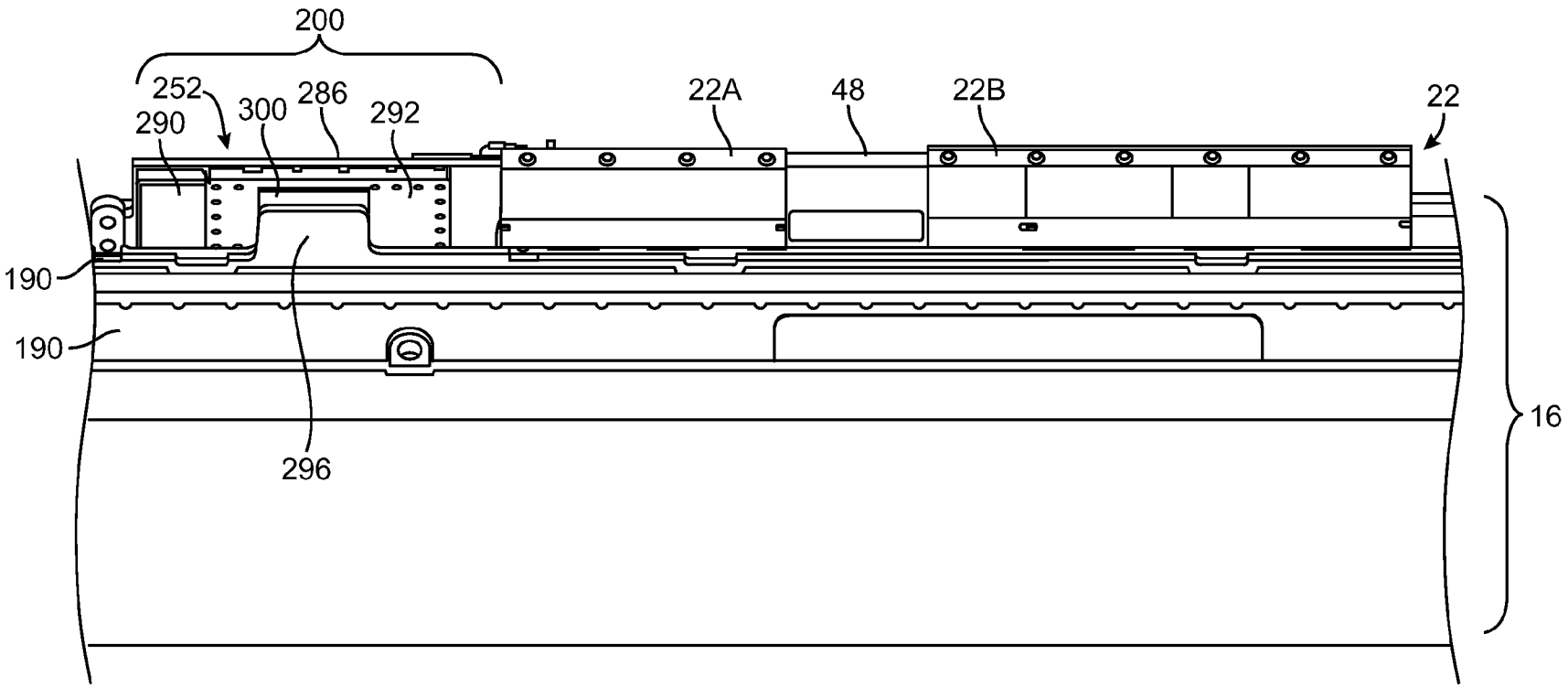
FIG. 14 is a perspective view of a clutch barrel antenna and clutch barrel transceiver when mounted to housing structures in a portable electronic device in accordance with an embodiment of the present invention.

FIG. 14 is a perspective view similar to that of FIG. 11, but showing antenna 22 and transceiver circuitry 252 mounted to housing portion 16. As shown in FIG. 14, circuitry 252 may be mounted to the end of antenna support structure 48 in region 200 next to heat sink 296.

Circuitry 252 and antenna 22 have an elongated shape that allows these components to be mounted within clutch barrel 38 of device 10 (FIG. 1). In the view depicted in FIG. 14, clutch barrel cover 42 is not shown, so that the interior components of clutch barrel 38 are not obstructed from view. Clutch barrel cover 42 is shown in the cross-sectional view of clutch barrel 38 in FIG. 12. As shown in FIG. 12, clutch barrel cover 42 may encase and surround antenna support structure 48 and may likewise surround and encase transceiver circuitry 252. Antenna elements 22A and 22B, which are supported on the outer surface of antenna support structure 48, are also covered by clutch barrel cover 42. To ensure that the operation of antenna 22 is not blocked by the presence of cover 42, clutch barrel cover 42 may be formed from a dielectric such as plastic.

During operation, heat may be generated by transceiver circuitry 252. This heat may be drawn away by heat sink 296 in frame 190. Heat transfer material 300 may be used to provide good thermal contact between circuitry 252 (e.g., can 292) and heat sink 296. Heat transfer material 300 may be formed from heat conducting foam, thermal compound (also sometimes referred to as thermal grease or thermal paste), heat conducting adhesive, or any other suitable heat conducting structures.

The foregoing is merely illustrative of the principles of this invention and various modifications can be made by those skilled in the art without departing from the scope and spirit of the invention.

What is claimed is:

1. A portable wireless electronic device, comprising:

an upper housing having an exterior housing surface and having at least one metal frame that supports a portion of the exterior housing surface;

a lower housing that is attached to the upper housing by a hinge;

a clutch barrel associated with the hinge that has a clutch barrel cover;

radio-frequency transceiver circuitry within the clutch barrel cover;

at least one antenna element within the clutch barrel cover; and a transmission line path within the clutch barrel cover that connects the radio-frequency transceiver circuitry with the antenna element, wherein a portion of the metal frame forms a heat sink that draws heat away from the radio-frequency transceiver circuitry.

2. The portable wireless electronic device defined in claim 1 further comprising heat conducting material interposed between the radio-frequency transceiver circuitry and the heat sink.

3. The portable electronic device defined in claim 2 wherein the heat sink comprises a tab-shaped extension of the metal frame that rests against the heat conducting material.

4. The portable electronic device defined in claim 1 further comprising:

at least one printed circuit board mounted in the lower housing;

digital communications circuitry on the printed circuit board; and a communications path that connects the digital communications circuitry on the printed circuit board to the radio-transceiver circuitry in the clutch barrel.

5. The portable electronic device defined in claim 4 further comprising a peripheral component interface express connector that connects the communications path to the printed circuit board.

6. The portable electronic device defined in claim 1 wherein the radio-frequency transceiver circuitry comprises a printed circuit board and at least one transceiver integrated circuit that is mounted to the printed circuit board to form a radio-frequency module in the clutch barrel.

7. The portable electronic device defined in claim 6 wherein the radio-frequency module comprises a coaxial cable connector that receives a coaxial cable in the transmission line path.

8. The portable electronic device defined in claim 7 wherein the radio-frequency module comprises:

an input radio-frequency amplifier that receives radio-frequency signals from the antenna element; and an output radio-frequency amplifier that supplies radio-frequency signals from the transceiver circuitry to the antenna element.

9. The portable electronic device defined in claim 1 further comprising at least a second antenna element in the clutch barrel that is coupled to the radio-frequency transceiver circuitry by the transmission line path.

10. The portable wireless electronic device defined in claim 1 wherein the heat sink formed by the portion of the metal frame is located in the clutch barrel.

11. Clutch barrel structures located in a clutch barrel between an upper and lower housing portion of a portable electronic device, comprising:

antenna structures in the clutch barrel;

radio-frequency transceiver circuitry in the clutch barrel; and a frame member heat sink in the clutch barrel configured to draw heat away from the transceiver circuitry.

12. The clutch barrel structures defined in claim 11 further comprising:

a dielectric clutch barrel cover that covers the antenna structures and the radio-frequency transceiver circuitry.

13. The clutch barrel structures defined in claim 12 wherein the radio-frequency transceiver circuitry comprises a radio-frequency module having a printed circuit board, at least one radio-frequency integrated circuit mounted on the printed circuit board, and at least one shielding can mounted to the printed circuit board over the radio-frequency integrated circuit.

14. The clutch barrel structures defined in claim 13 wherein the frame member heat sink is next to the shielding can.

15. The clutch barrel structures defined in claim 14 wherein the frame member heat sink is formed from part of a metal frame that is mounted to a portable computer housing cover.

16. The clutch barrel structures defined in claim 11 wherein the antenna structures comprise at least two flex circuit antenna elements mounted to a dielectric antenna support structure.

17. The clutch barrel structures defined in claim 16 wherein the frame member heat sink comprises a metal heat sink extension to a metal housing frame, wherein the metal heat sink extension is adjacent to the transceiver circuitry, and wherein the antenna structures comprise a dielectric antenna support structure that is mounted to the metal housing frame.

18. Structures in a portable computer that has an upper housing portion, a lower housing portion, and a portable computer clutch barrel associated with a hinge that connects the upper housing portion to the lower housing portion, comprising:

at least one antenna element in the portable computer clutch barrel;

radio-frequency transceiver circuitry in the portable computer clutch barrel; and a metal frame in the upper housing, wherein the metal frame has a tab-shaped heat sink extension that serves as a heat sink for the transceiver circuitry.

19. The structures defined in claim 18 further comprising:

logic circuitry in the lower housing portion that generates digital data signals;

a digital data communications path between the logic circuitry and the radio-frequency transceiver circuitry; and digital communications circuitry in the portable computer clutch barrel that is associated with the radio-frequency transceiver circuitry and that receives digital data signals from the logic circuitry over the digital data communications path.

20. The structures defined in claim 19 further comprising a radio-frequency transmission line path in the portable computer clutch barrel between the radio-frequency transceiver circuitry and the antenna element, wherein the radio-frequency transceiver circuitry produces radio-frequency signals based on the received digital data that are conveyed to the antenna element over the radio-frequency transmission line path and that are transmitted through the antenna element.

21. The structures defined in claim 20 further comprising:

a dielectric antenna support structure, wherein the antenna element comprises a flex circuit mounted to the dielectric antenna support structure and wherein the dielectric antenna support structure is mounted to portions of the metal frame within the portable computer clutch barrel.

22. The structures defined in claim 19 wherein the digital communications circuitry associated with the radio-frequency transceiver circuitry is configured to receive multiple lanes of digital data signals from the logic circuitry over the digital data communications path.

23. The structures defined in claim 19 further comprising a radio-frequency transmission line path in the portable computer clutch barrel between the radio-frequency transceiver circuitry and the antenna element, wherein the radio-frequency transceiver circuitry receives radio-frequency signals from the antenna element and, based on the received radio-frequency signals, generates digital data signals that are transmitted to the logic circuitry by the digital communications circuitry.

* * * * *